United States Patent [19]

Lindley

[11] Patent Number: 4,556,999

[45] Date of Patent: Dec. 10, 1985

[54] APPARATUS FOR REMOVING NOXIOUS FUMES AND GASES FROM A COMMODE BOWL AND PREVENTING THEIR ESCAPE TO THE IMMEDIATE VICINITY

[76] Inventor: John E. Lindley, 1410 20th Ave., Meridian, Miss. 39301

[21] Appl. No.: 671,787

[22] Filed: Nov. 15, 1984

[51] Int. Cl.[4] ..... E03D 9/05; E03D 9/052; A47K 13/00

[52] U.S. Cl. ..... 4/217; 4/216; 4/209 R

[58] Field of Search ..... 4/213, 217, 211, 209, 4/352, 348, 306, 216

[56] References Cited

U.S. PATENT DOCUMENTS

| | | | |
|---|---|---|---|
| 792,730 | 6/1905 | Rix | 4/217 |
| 962,490 | 6/1910 | Bruder | 4/217 |
| 1,972,076 | 9/1934 | Cross | 4/217 |
| 2,079,733 | 5/1937 | Cummings | 4/217 X |
| 2,172,506 | 9/1939 | Garger | 4/217 |
| 2,728,088 | 12/1955 | Gudish | 4/217 |
| 2,988,756 | 6/1961 | Hartley | 4/213 |
| 3,600,724 | 8/1971 | Stamper | 4/217 |
| 3,740,772 | 6/1973 | Paley | 4/217 |
| 4,125,906 | 11/1978 | Weiland | 4/217 |
| 4,402,091 | 9/1983 | Ellis et al. | 4/217 |

*Primary Examiner*—Henry K. Artis

*Attorney, Agent, or Firm*—Cushman, Darby & Cushman

[57] ABSTRACT

Apparatus for removing and preventing escape of noxious fumes from a commode bowl has a plurality of circumferentially arranged radially inwardly directed air inlet passages adjacent the bowl rim for the intake of ambient air surrounding the commode. A plurality of circumferentially arranged radially outwardly directed outlet passages are positioned below the inlet passages for suction withdrawal of the noxious fumes mixed with the incoming air. The inner edge of the commode opening between the inlet and outlet passages is configured to create turbulence within the bowl to mix the fumes therein with the incoming air.

16 Claims, 4 Drawing Figures

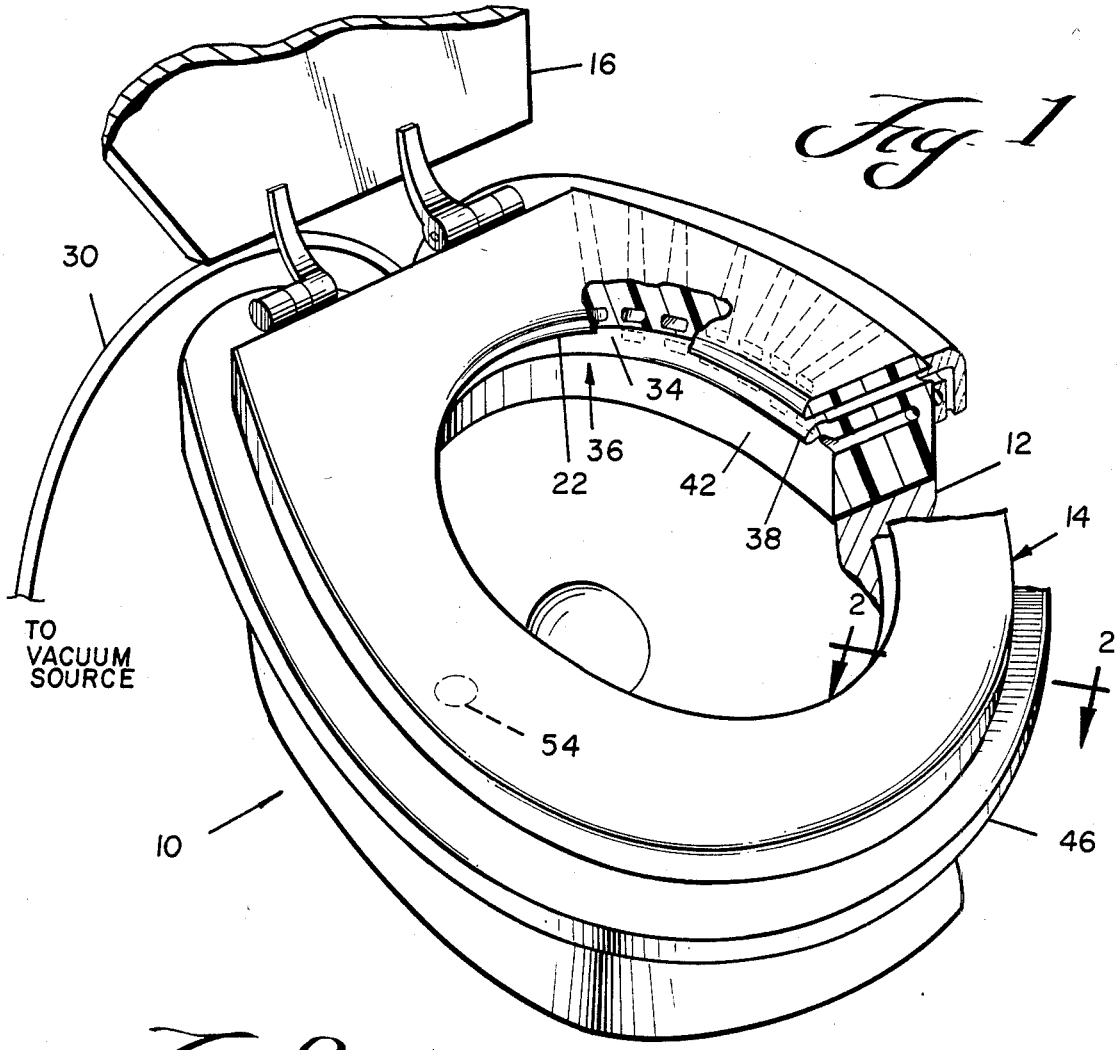
Fig. 1
Fig. 2
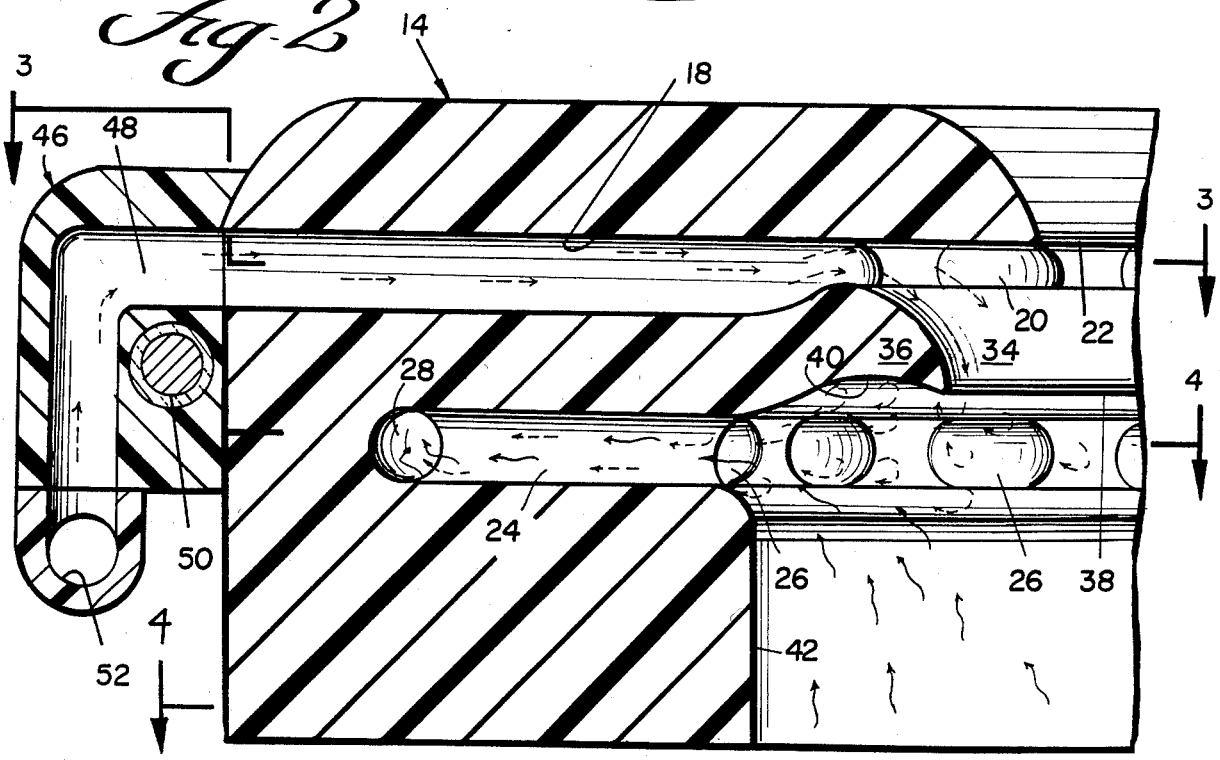

APPARATUS FOR REMOVING NOXIOUS FUMES AND GASES FROM A COMMODE BOWL AND PREVENTING THEIR ESCAPE TO THE IMMEDIATE VICINITY

FIELD OF THE INVENTION

The present invention relates to commode exhaust systems and, more particularly, to improved apparatus for removing noxious fumes from a commode bowl and preventing their escape to the immediate vicinity.

BACKGROUND OF THE INVENTION

Noxious odors or gaseous fumes present in commodes and in areas about commodes have always been a normal but unpleasant result attendant commode use. These odors are especially prevalent in areas containing many commodes, when a commode is contained in a small room, such as in mobile homes, trains, buses or airplanes, and also with portble commodes not housed in a separate room, such as bedpans. In the past, venting systems attempting to remove noxious odors resulting from commode use have employed suction manifolds which conform to the configuration of and are usually attached directly to the commode seat. However, these venting systems have merely attempted to remove air and fumes from within the commode through the suctioning of the air containing noxious fumes from within the bowl of the commode.

One such system is disclosed in U.S. Pat. No. 1,972,076 to Cross which utilizes an outlet suction chamber attached between the seat and the bowl of the commode or toilet. The problem with Cross is that a substantial amount of the noxious odors may escape from the bowl of the commode into the immediate vicinity. The suction outlets in Cross are placed at the top of the bowl and thus do not operate to remove odors until the odors rise nearly to the top of the bowl. Once a user rises from a commode it becomes an open chamber.

Therefore, under the Cross disclosure, any noxious fumes which ahve not reached to top region of the bowl, before it becomes an open chamber, are allowed to escape and pollute the breathing medium of the user.

Another such system is shown in U.S. Pat. No. 2,151,138 to Morris wherein there is disclosed a suction duct arrangement similar to Cross located toward the outer margin of the bowl. As in Cross, odorous gases may escape the bowl once the user rises due to less of vacuum and an incomplete evacuation of the fumes. Other U.S. patents, such as those of U.S. Pat. Nos. 2,988,756, to Hartley and 4,094,023 to Smith, also rely solely on a similar arrangement of suction ducts in communication with the interior of the bowl of the commode. All of the above-mentioned systems, and systems employing similar structure, rely solely upon the suction present at various suction ports for the removal of the noxious fumes. As mentioned above, however, a problem exists in that the commode, being essentially an open chamber when not occupied, may allow much of the noxious gases to escape the bowl when not actually occupied. Further, it is difficult to obtain a proper flow of air and gaseous fumes out of the bowl, in such systems, necessary for complete removal of the entire mass of noxious gases present in the commode during use because the admission of air to the bowl to achieve such flow is usually mostly blocked by the user, particularly when the occupant is obese.

BRIEF SUMMARY OF THE INVENTION

The present invention overcomes the problems found in the prior art through the introduction of ambient air into the bowl when occupied and the production of turbulent air currents about the rim of the bowl moving towards its center and then downward about the interior of the bowl to mix with the fumes therein followed by discharge of the mixture from the bowl below the level of the air introduction and subsequent filtering to remove the odors. The created turbulence mixes the fumes with incoming air and allows more complete movement of the noxious fumes towards suction outlets for ultimate removal, thus effectively enhancing fume removal while simultaneously containing fumes within the bowl when not occupied. Such a system has many advantages. The incoming air may also be heated and thus by its movement toward the center of the bowl warm the posterior of an occupant of the commode which can have certain therapeutic effects. In addition, a medicinal mist or other type of medicant may be injected into the incoming air, thus medicating the posterior of an occupant, or performing other functions within the interior region of the bowl.

The turbulent air currents may be provided by a plurality of circumferentially arranged air inlet ports for permitting an intake of ambient air surrounding the commode working together with a plurality of circumferentially arranged suction outlet ports positioned below the inlet ports and operatively coupled to a means for producing a vacuum, thus suctioning the noxious odors and fumes out of the bowl while drawing air thereinto through the inlet ports. Preferably, a downwardly extending especially contoured circumferential fin is positioned between the inlet ports and the exhaust ports to direct the incoming air turbulently downward circumferentially about the interior of the bowl to thoroughly mix with the fumes therein while simultaneously exhausting the mix through the suction ports.

The present invention may be adapted for use with bedpans or other human waste disposal chambers, as well as with conventional fixed toilets or water closets. Additionally, it may be largely constructed of low cost disposable plastic material.

BRIEF DESCRIPTION OF THE DRAWINGS

FIG. 1 is a perspective view, partly in section, of a commode exhaust system according to the present invention; p FIG. 2 is an enlarged cross-sectional view of the commode seat taken along line 2—2 of FIG. 1;

DETAILED DESCRIPTION OF THE INVENTION

Figure 3:
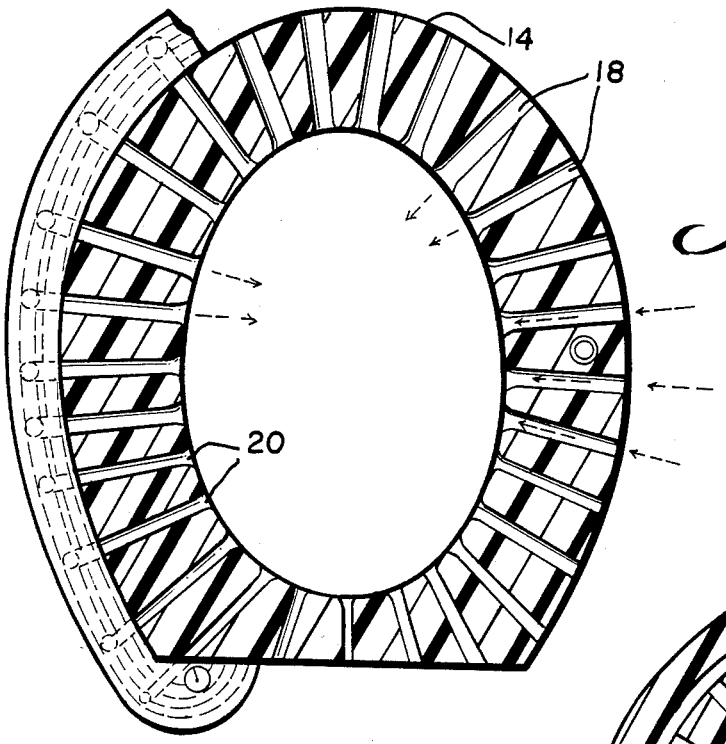
FIG. 3 is a horizontal sectional view, taken along line 3—3 of FIG. 2, showing the air intake passages in the commode seat.

Referring now to FIG. 1 of the drawings, there is shown a conventional flushing toilet or commode 10 having a bowl 12 provided with the usual hinged seat 14 and lid 16. Exemplary of its adaptation, this invention is shown as being incorporated in the seat 14 which is generally annular in configuration, though somewhat elongated from front to rear. Extending through the seat 14 are a plurality of circumferentially arranged generally radially inwardly directed air inlet passages 18. The inner ends of the inlet passages 18 terminate in air inlet ports 20 spaced radially outwardly of the upper inner edge or rim 22 of the seat 14. Preferably, such inlet ports 20 are somewhat upwardly restricted to increase the velocity of the air flowing therethrough.

Spaced below the inlet passages 18 is a similar series of suction outlet passages 24 having outlet ports 26 spaced radially outward of the inlet ports 20. At their outer ends the outlet passages 24 terminate in a suction manifold 28. As shown, the manifold 28 may be incorporated in the seat 14 itself, which may be made of molded plastic or, alternatively, the manifold may be a separate part surrounding the periphery of the seat, an arrangement not shown. Connected to the manifold 28, preferably at the rear of the seat, is a conduit, preferably in the form of a flexible hose 30, which leads to an appropriate source 32 of reduced pressure, i.e. suction. The suction source 32 may take the form of a conventional electrically operated suction pump or fan or blower (not shown) or for portable commodes, such as a bedpan, a portable suction pump (not shown), such as that used in a conventional vacuum cleaner or even a hand held vacuum cleaner.

Projecting inwardly and downwardly from the bottom of the air inlet ports 20 is a curved convex surface 34 formed by a circumferential fin 36 that terminates in an inner edge or lip 38 spaced somewhat radially outwardly of the inner rim 22 of the seat 14. Preferably, the convex surface 34 extends into the outlet ends of the inlet passages 18 to restrict the inlet ports 20. The fin 36 is provided with a concave undersurface 40 terminating at its outer edge adjacent the top of the outlet ports 26 of the suction passages 24. Below these outlet ports 26 the inner surface 42 of the seat opening is generally of the same distance from its center as that of the ports 26.

Figure 4:
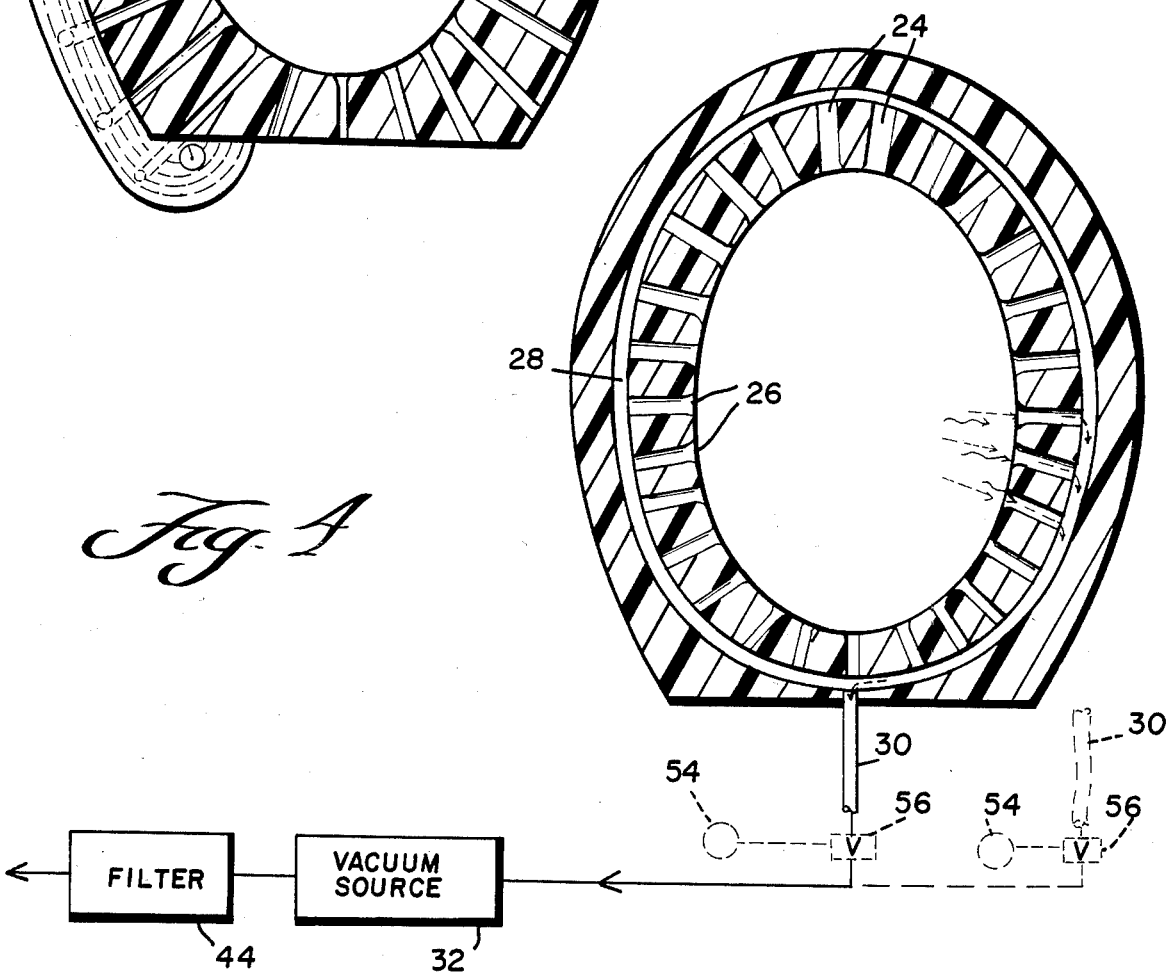
FIG. 4 is a horizontal sectional view, taken along line 4—4 of FIG. 2, showing the suction passages in the commode seat.

In operation, the suction source of pump 32 is started, as by a manual switch (not shown) to draw air and other gases from within the bowl 12 through the suction passages 24 through the manifold 28 and through the pump for discharge to the atmosphere. The discharge may take place at a remote location but in actual practice need not be far removed from the commode 10 provided an appropriate filter 44 is interposed between the maifold 28 and the pump 32 or between the pump and an outlet which discharges the mixed air and other gases to the atmosphere as shown in FIG. 4. The filter 44 may contain activated charcoal but in actual practice it has been found unnecessary to use a filter of that nature. In fact, it has been found in actual practice that a fibrous sheet material filter such as that used with a conventional vacuum cleaner i.e. of fabric, paper or other fibrous sheet material, will suffice to remove noxious odors from the gases discharged through the conduit 30.

When the commode 10 is in actual use and the central seat opening is substantially blocked by the occupant, the creation of at least a partial vacuum in the commode chamber by the pump 32 draws air through the air inlet passages 18 with its velocity increasing as it exits through the air inlet ports 20. As the air is then drawn down into the bowl 12 of the commode 10, its passage across the convex upper surface 34 of the fin 36 creates vortices at the inner edge 38 of the fin thus creating turbulence about this edge and even further down therebelow. The creation of these vortices is enhanced by the concave undersurface 40 of the fin 36 resulting in thorough mixing of any noxious fumes in the bowl 12 with the air being admitted thereinto through the air inlet passages 18 and thence exit of the mixture through the suction outlet passages 24.

When the commode 10 is not in use and the central opening in the seat 14 is not blocked by an occupant, it has been found that operation of the suction pump 32 still tends to create turbulence in the bowl 12 by downward passage of air through the central opening in the seat 14 itself, as well as through the air inlet passages 18, thus preventing escape of noxious fumes and gases from the bowl upwardly through the central seat opening with continuing withdrawal of the mixed gases through the outlet passages 24.

Modifications of the above described embodiment are, of course, possible. Thus, for example, the seat 14 may be made in two horizontally separated sections, one containing the inlet passages 18, and the other the outlet passages 24. Further, the seat 14 may be made integral with the bowl 12 of the commode 10, such as in a bedpan construction. Still further the invention may be incorporated in the rim portion of the bowl 12 instead of in the separate seat 14.

Additionally, although the arrangement for the admission of air inwardly through the seat 14 is shown as separate passages 18, it will be understood that various other arrangements will perform the function satisfactorily. For example, the seat could be formed in vertically spaced layer-like sections separated by suitable supporting structure for the admission of air inwardly between such sections. Similarly, the function of the suction outlet passages 24 could be performed by a space vertically separating layer-like seat sections having suitable supporting structure therebetween, while the outer periphery of such space would be sealed and surrounded by a tubular suction-manifold having suction ports opening to the space.

Other modifications also are possible. Thus, the seat 14 may be constructed with an exterior peripheral portion 46 having angular passages 48 communicating with the inlet passages 18, with the angular passages having downward facing inlets. The peripheral portion 46 may also be provided with an electrically insulated electric resistance type heating element 50 arranged to heat the air entering the air inlet passages 18 to obtain the aforedescribed beneficial results from heating the posterior of the user. A suitable control (not shown) may be provided for the heating element 50 to adjust the temperature of the incoming air.

Further, the air inlet passages 18 may be connected to an air inlet manifold 52, as shown in FIG. 2 to the inlet (not shown) of which apparatus (not shown) may be connected to inject a medicinal mist or other type of medicant into the air entering the inlet passages 18 to appropriately medicate the posterior of a user.

Other options available to the invention are the incorporation in the seat 14 of a pressure-sensitive switch 54 connected to the power source of the vacuum pump 32 to automatically activate the latter when a user of the commode seats him or herself upon the seat 14. The connection may also include a time delay switch (not shown) which will activate the vacuum pump 32 for a predetermined period of time after the user rises to insure continuous removal of noxious odors until the commode 10 is flushed. The invention is especially applicable to multiple units, i.e. bathroom and hospital usage, where a single vacuum source is connected to a number of units or units can be detachably connected to a single suction source, e.g. in a hospital room. Such an arrangement is shown in dotted lines in FIG. 4 wherein the discharge conduits 30 of a number of commodes are connected, possibly detachably, to a common suction line leading to the vacuum source 32. A normally-closed solenoid valve 56 is interposed in each conduit 30 and is controlled by the switch 54 of the corresponding commode to open the conduit when the commode is in use.

Further, the air inlet ports 20 may face tangentially inward to create a swirling of the incoming air about the vertical axis of the bowl 12 to even more effectively mix the fumes with the air for complete withdrawal of the noxious odors through the outlet passages 24.

It thus will be seen that the objects and advantages of this invention have been fully and effectively achieved. It will be realized, however, that the foregoing specific embodiment has been disclosed only for the purpose of illustrating the principles of this invention and is susceptible of modification without departing from such principles. Accordingly, the invention includes all embodiments encompassed within the spirit and scope of the following claims.

I claim:

1. Apparatus for removing and containing noxious fumes in a commode bowl having a generally annular seat portion comprising:

air inlet passage means operatively associated with said bowl for passage of ambient air thereinto, said inlet passage means having air inlet means outside said bowl and having air outlet means facing inward about and adjacent the inner periphery of said bowl adjacent the upper portion thereof; and gas outlet passage means operatively associated with said bowl and having gas inlet means about and adjacent the inner periphery of said bowl below said air outlet means and having gas outlet means outside said bowl adapted to be connected to a source of negative pressure for withdrawing the incoming air and gases mixed therewith from within said bowl for discharge outside thereof.

2. The apparatus defined in claim 1 including means defining a downwardly inclined convex surface extending peripherally about and adjacent the inner periphery of said bowl below the air outlet means and above the gas inlet means to create vortex turbulence of the incoming air to thoroughly mix it with fumes within the bowl before withdrawal thereof.

3. The apparatus defined in claim 2 wherein the downwardly curved surface is formed by a peripheral fin having a concave undersurface to enhance the creation of vortex turbulence.

4. The apparatus defined in claim 3 wherein the fin terminates in an inner peripheral edge spaced radially outwardly of the upper inner edge of the seat portion.

5. The apparatus defined in claim 1 including means for heating the air entering the air inlet passage means.

6. The apparatus defined in claim 1 including means for injecting a medicant into the air entering the air inlet passage means.

7. The apparatus defined in claim 1 or 3 in which the air outlet means and the gas inlet means each comprises a peripheral row of ports spaced radially outward of the upper inner edge of the seat portion.

8. The apparatus defined in claim 1 including a pressure-sensitive switch in the seat portion adapted to be connected to the source of negative pressure for activating the latter when a user occupies the seat portion.

9. The apparatus defined in claim 8 including a time-delay relay in the connection for continuing activation of the source for a predetermined period of time after a user rises from the seat portion.

10. The apparatus defined in claim 1 including a fibrous filter connected to the outlet means of the outlet passages for removing odors from the mixture.

11. The apparatus defined in claim 1 in which the bowl and seat portion are of one piece construction.

12. The apparatus defined in claim 1 in which the seat portion is a separate part of the commode and the air passage means are incorporated in said seat portion.

13. The apparatus defined in claim 7 in which the ports of the air outlet means face generally radially inwardly.

14. The apparatus defined in claim 1 in which the ports of the air outlet means face generally tangentially inward to cause a swirling of the incoming air about the center of the bowl.

15. The apparatus defined in claim 2 in which the surface terminates in an inner peripheral edge spaced radially outwardly of the upper inner edge of the seat portion.

16. A plurality of the apparatus defined in claim 1 and including:

means connecting the gas outlet means of each apparatus to a common source of negative pressure;

normally-closed valve means in each of said connecting means; and a pressure sensitive switch in the seat portion of each of said apparatus controlling the respective valve means for opening the latter when a user occupies the seat portion.

* * * * *